United States Patent [19]

Kelly

[11] 4,254,651

[45] Mar. 10, 1981

[54] DEVICE FOR BENDING METAL OBJECTS

[76] Inventor: William R. Kelly, "Lugano", Rugby, New South Wales, Australia, 2625

[21] Appl. No.: 8,242

[22] Filed: Feb. 1, 1979

[51] Int. Cl.[3] ..... B21D 7/06

[52] U.S. Cl. ..... 72/389

[58] Field of Search ..... 72/389, 386, 316

[56] References Cited

U.S. PATENT DOCUMENTS

| | | | |
|---|---|---|---|
| 3,918,286 | 11/1975 | Whitehead | 72/389 |
| 4,004,445 | 1/1977 | Larson | 29/526 |
| 4,141,235 | 2/1979 | Ishihara | 72/213 |

FOREIGN PATENT DOCUMENTS

| | | | |
|---|---|---|---|
| 6446 | of 1909 | United Kingdom | 72/389 |
| 681293 | 3/1950 | United Kingdom | 72/389 |

*Primary Examiner*—Francis S. Husar
*Assistant Examiner*—Gene P. Crosby
*Attorney, Agent, or Firm*—Balogh, Osann, Kramer, Dvorak, Genova & Traub

[57] ABSTRACT

The present invention concerns a device for bending pipes, tubes, bars and rods such as may be used in roof racks, crash bars and in general plumbing. The device includes a frame with an arm extending to both sides, a pair of spaced stop members on the arm, a hydraulic ram fixed to the frame, a link connected to the piston of the ram and a former mounted on the end of the link. The arrangement is such that two or more adjacent bends can be made in a rod or bar so that the bends are in different planes.

6 Claims, 4 Drawing Figures

DEVICE FOR BENDING METAL OBJECTS

FIELD OF THE INVENTION

Generally this invention concerns devices and methods for working of metal objects and especially to devices commonly used for the bending of pipe, tube, rod, bars and similar elongate members, and more particularly to portable devices of this kind capable of use on a job site. The invention also includes objects when bent by the device of this invention.

BACKGROUND OF THE PRIOR ART

Bending and like devices are well known and generally comprise an elongate frame having an arm transverse thereto. A hydraulic ram is fitted lengthwise to the frame and has a die or former mounted on the end of the piston rod. On extension of the ram, the former pushes against a workpiece, the sides of which are held by stops mounted on the arm, to form a bend therein. In practice these prior devices suffer certain disadvantages—thus if it is required to bend a workpiece adjacent an already bent section, the end of the latter section tends to strike the frame and interfere with the bending process. Additionally, a problem with a number of prior devices is that the stops have to be removed in order to free the workpiece and/or even to initially fit the workpiece before bending.

SUMMARY OF THE INVENTION

Accordingly, it is an object of this invention to provide a bending machine for pipe, rod or the like, which does not suffer from the above disadvantages. In fact, the device is capable of bending workpieces in such a way that two or more adjacent or successive bends can be made therein such that said bends lie in different planes. This is achieved because the end of one bend does not strike the frame during forming of an adjacent bend. Thus the device of this invention has particular utility in the construction of roof racks and bull bars and crash bars for motor vehicles, and in general plumbing and vehicle maintenance.

Thus according to this invention, a device for bending pipe or the like elongate workpieces comprises an elongated frame, an arm fixed to said frame and extending laterally to both sides thereof, a pair of laterally spaced stop members mounted on said arm, motivating means fixed to said frame having a relatively moveable part for extending and retracting lengthwise of said frame, a link connected at one end to said relatively moveable part and extending lengthwise of said frame past said arm, and a former mounted on the end of said link remote from said relatively moveable part, the arrangement being such that on extension of said relatively moveable part, said former moves towards said arm, whereby to bend a workpiece held between said former and said stop members.

BRIEF DESCRIPTION OF THE VARIOUS FIGURES

The invention will be better understood by reference to the accompanying drawings, in which FIG. 1 is a side elevation schematically showing one form of the device of this invention, FIG. 2 is a schematic illustration of a basic component layout thereof, showing a "workpiece", FIG. 3 is a plan view of the device of FIG. 1, and FIG. 4 is an end view of the device as seen from the former end.

DETAILED DESCRIPTION

Figure 1:
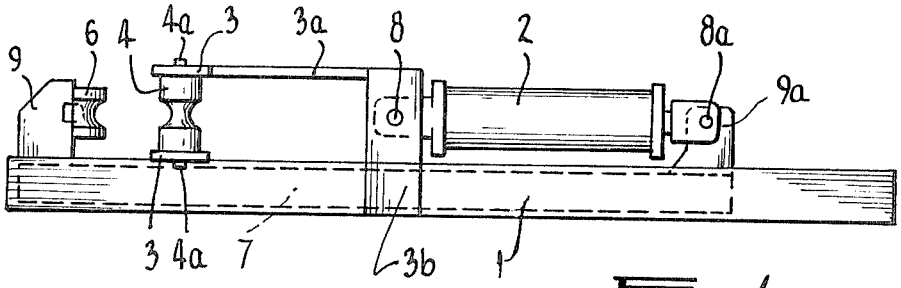

In the embodiment illustrated, frame 1 supports hydraulic ram 2 by pin 8 in upright members (only one visible) 3*b*. A pair of arms 3 are rigidly fixed transversely to frame 1, one above the other. The top arm is supported by struts 3*a* which in turn are attached to frame 1 by uprights 3*b*. A pair of stops 4 are detachably held between arms 3 by pins 4*a*. Pins 4*a* fit in holes 5 in arms 3 and stops 4 can be variably spaced by suitable selection of holes 5. The former 6 is connected via linkage 7 to the end of the piston rod of the ram by pin 8*a*. Former 6, which has a free upper end (not connected to or overlapped by frame 1 or arms 3), is detachably mounted at its bottom or lower end on linkage 7 whereby various formers for different purposes may be fitted to the device.

Figure 2:
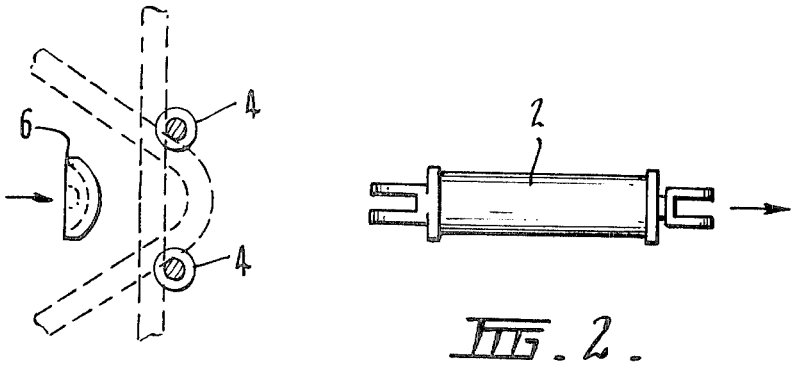
Figure 3:
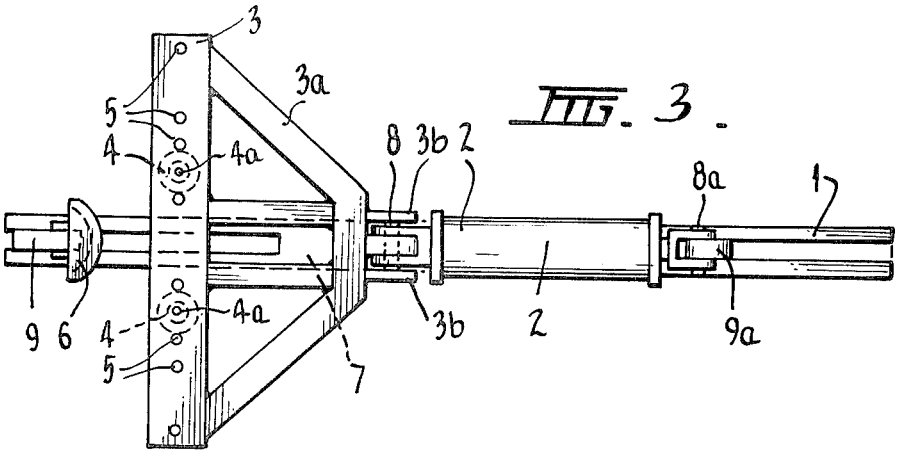

In operation, the workpiece is set between former 6 and stops 4, and when the ram is extended, it is bent so that the peak of the bend faces the ram (see left half of FIG. 2). It should be noted that this is basically a "pulling" operation, whereas that of the prior devices is a "pushing" operation, in which the peak of the bend faces away from the ram. Consequently, since the ends of the workpiece bent by the device of the present invention move away from the frame during bending, any bends already present, and adjacent to the present operation, do not strike the frame, as they would in prior devices. Further, having regard to the illustrations it can be seen that (once the ram is retracted) the workpiece simply comes away from the stops, whereas in prior art devices this is not the case, and further, unless the workpiece is short enough to be removed laterally of the frame, the stops have first to be removed to free the workpiece, since it will be trapped in the frame between the stops and the ram. This is a time consuming process and reduces the rate of work and operator output.

Figure 4:
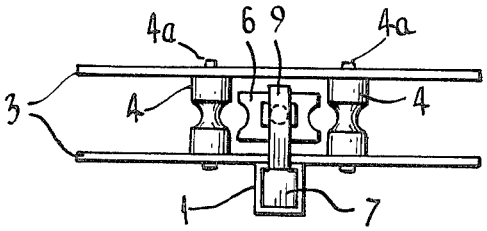

Since the workpiece is positioned between the former and the ram, obviously the piston rod does not connect directly to the former. As shown in the illustrations, the link 7 has a horizontal portion running in the frame (see FIG. 4) and a pair of upright portions (9, 9*a*) at either end, one (9) connected to former 6, and the other (9*a*) connected to the piston rod via pin 8*a*. These upright portions run in slots in the frame 1, clearly visible in FIG. 1.

It will be obvious to the man skilled in the art that ram 2 could be fixed to the frame at 8*a* and to the link 7 at 8 instead of the reverse situation as illustrated; in this case the ram would have to be double acting since the bending would be done on the retraction stroke. Similarly, the ram can be hand pumped, or arranged to be connected to any suitable power source, e.g. the hydraulic system of a tractor. Additionally, instead of a hydraulic ram, it will be appreciated that a screw device or in fact any linear motivator can be used. Various other components of a conventional nature such as a calibrated scale may be added if desired if repetitious work is involved.

Whilst the foregoing description has referred to certain uses, e.g. pipe bending, to which the invention may be put, other uses are possible where metal articles require bending or deforming.

Bearing in mind the above comments, it is to be understood that the foregoing description is by way of example only, and the scope of the protection sought is to be limited only by the scope of the appended claims.

I claim:

1. A device for making a plurality of adjacent bends lying in different planes in a metal object, comprising an elongate frame, a first arm rigidly fixed to said frame, and extending laterally to both sides thereof, a second arm rigidly fixed to said frame overlying said first arm, a plurality of holes in each arm, said holes in substantial vertical alignment, a pair of stop members each having a through-bore, a pin in said bore projecting from both sides thereof, the projecting portions located in a pair of said vertically aligned holes, to thereby position each said stop member; a hydraulic ram fixed to said frame to extend and retract lengthwise thereof, and having its piston rod projecting from the end of the ram furthest from said arms, a link extending lengthwise of said frame, beneath said ram and said first arm, said link having an upwardly extending lug portion at each of its ends, one lug portion being connected to the end of said piston rod, and the other lug portion mounting a former, the upper end of said former being free of said frame and said arms, when the bent metal object is removed from said device, the arrangement being such that on each extension of said ram, said former moves towards said arms, whereby to make a bend in said object held between said former and said stop members, the ends of said object moving away from said arms and said frame during successive bending operations on said object, and on each retraction of said ram, said former moves away from said arms and said object comes away from said stop members.

2. A device as defined in claim 1 wherein said former is detachably fixed to said other lug portion of said link to enable replacement by formers of different size.

3. A device for making a plurality of adjacent bends lying in different planes in a metal object, comprising an elongate frame, a first arm rigidly fixed to said frame, and extending laterally to both sides thereof, a second arm rigidly fixed to said frame overlying said first arm, a plurality of holes in each arm, said holes in substantial vertical alignment, a pair of stop members each having a through-bore, a pin in said bore projecting from both sides thereof, the projecting portions located in a pair of said vertically aligned holes, to thereby position each said stop member, actuating means fixed to said frame, having a relatively movable part projecting therefrom for extending and retracting in a direction lengthwise of said frame, a link extending lengthwise of said frame beneath said actuating means and said first arm, said link having an upwardly extending lug portion at each of its ends, one lug portion being connected to the end of said movable part, and a former being mounted on the other lug portion of said link, the upper end of said former being free of said frame and said arms when the bent metal object is removed from said device, the arrangement being such that on each extension of said movable part, said former moves towards said arms, whereby to make a bend in said object held between said former and said stop members, the ends of said object moving away from said arms and said frame during successive bending operations on said object, and on each retraction of said movable part, said former moves away from said arms and said object comes away from said stop members.

4. A device as defined in claim 3 wherein said actuating means is a hydraulic ram, and said relatively moveable part is the working end of the piston rod thereof.

5. A device as defined in claim 3 wherein said former is detachably fixed to said link, to enable replacement by formers of different size.

6. A device as defined in claim 3 wherein said stop members are fixed to said arm by means enabling the lateral spacing thereof to be adjusted.

* * * * *